United States Patent [19]

Berger et al.

[11] Patent Number: 4,995,769

[45] Date of Patent: Feb. 26, 1991

[54] ROD CONVEYOR AND COMPARTMENT THEREFOR

[75] Inventors: Maurice Berger, Cortaillod; Michael Lauenstein, Cormondrèche, both of Switzerland

[73] Assignee: Fabriques de Tabac Reunies, S.A., Neuchatel, Switzerland

[21] Appl. No.: 330,306

[22] Filed: Mar. 29, 1989

[30] Foreign Application Priority Data

Apr. 5, 1988 [CH] Switzerland ..... 1248/88

[51] Int. Cl.[5] ..... B65B 19/04; B65G 65/02; B65G 65/40

[52] U.S. Cl. ..... 414/403; 198/347.1; 414/411; 414/414

[58] Field of Search ..... 414/403, 404, 411, 414; 198/347.1–347.4; 220/345

[56] References Cited

U.S. PATENT DOCUMENTS

| | | | |
|---|---|---|---|
| 2,653,723 | 9/1953 | Bergman | 414/403 X |
| 2,753,062 | 7/1956 | Loudon | 414/414 |
| 2,915,022 | 12/1959 | Dorey | 220/345 X |
| 4,170,285 | 10/1979 | Hinchcliffe | 198/347 |
| 4,455,117 | 6/1984 | Cartoceti | 414/414 X |
| 4,787,497 | 11/1988 | King et al. | 198/347 |

FOREIGN PATENT DOCUMENTS

| | | |
|---|---|---|
| 0090124 | 10/1983 | European Pat. Off. . |
| 0179964 | 5/1986 | European Pat. Off. . |
| 2139281 | 1/1973 | France . |
| 2120994 | 12/1983 | United Kingdom . |
| 2142894 | 1/1985 | United Kingdom . |
| 2171971 | 10/1986 | United Kingdom . |
| 2193184 | 2/1988 | United Kingdom . |

*Primary Examiner*—Sherman Basinger
*Attorney, Agent, or Firm*—Jeffery H. Ingerman

[57] ABSTRACT

An upper conveyor (4) moves full compartments (9) toward an emptying station (2) so that rods contained in the compartments enter a horizontal conduit (15). Empty compartments are taken over by a lift (7). Another conveyor (5) feeds empty compartments to the entrance of a filling station (3) into which the rods flow from the conduit. The full compartments are recovered on the lift or on still another conveyor (6) which can route them via the lift or via another lift (8) toward a storage position on one of the conveyors.

7 Claims, 5 Drawing Sheets

V
III
9
32
33
34
35
36
37

ROD CONVEYOR AND COMPARTMENT THEREFOR

This invention relates to manufacturing equipment, and more particularly to a rod-conveying installation, of the type having a conduit traversed by a flow of parallel rods, oriented perpendicular to the direction of the conduit, an extractor and a feeder respectively permitting rods to be extracted from the conduit at a first location and to be introduced into the conduit at a second location, the extractor and the feeder being respectively associated with a means for filling and with a means for emptying compartments, a system for conveying and storing these compartments, and control means permitting the delivery rate of the rods in the conduit and the displacement of the compartments in the conveying and storage system to be governed. The invention further relates to a rod compartment for use in the foregoing installation.

The inventive installation is intended to allow the simplest possible control of the feeding of rods to one or more rod-consuming machines as a function of the needs of this machine or these machines, while at the same time permitting one or more rod-producing machines to operate at their normal rates, independently of the consumer machine or machines.

The term "rod" as used herein has the meaning given to it in the tobacco industry. It thus designates cylindrical elements of limited length, e.g., cigarettes or sections of filter tips.

In the art of cigarette manufacture, there have been disclosed (see, for example, European Patent No. 0 179 964) storage apparatus which lead into a hose-pipe of rectangular cross-section a flow of rods guided by conveyor belts, which thus feed one or more cigarette-manufacturing machines and which comprise storage branches capable of being filled with rods in stock at a higher or lower rate. However, if the storage capacity of this apparatus is to be high, its operation involves numerous displacements of rods, with resultant risk of damage. Furthermore, this apparatus is bulky.

Loading apparatus has also been proposed (see, for example, European Patent No. 0 090 124) which can be fed with the contents of rod compartments of a standard type and standardized size, such as those used in the tobacco industry.

In certain prior art installations, such apparatus, which will hereafter be referred to as extractors and feeders, are associated with compartment conveying and storage systems. Such compartments are therefore used as a storage means. These installations make possible true direction of a compartment magazine by filling empty compartments or emptying full compartments in or from the conduit which guides the flow of rods.

Installations for directing a compartment magazine have already been proposed, particularly in published U.K. Patent Applications Nos. 2,142,894, 2,193,184, 2,120,994, and 2,171,971. However, in these prior art installations, the overall concept of the feeder, the extractor, and the conveying and storage system leads to a complicated and bulky design. It particularly involves in any case at least one turnover device in which two compartments are introduced together and undergo a 180 rotation about the same axis. In certain cases (Nos. 2,142,894 and 2,171,971) this axis is horizontal, while in others (Nos. 2,120,994 and 2,193,184) it is vertical.

It is an object of this invention to provide an improved rod-conveying installation which eliminates that operation while simplifying the overall concept of the installation.

Compartment-conveying installations using bottom-opening compartments have likewise been disclosed (French Patent No. 2,139,281). However, these prior art installations are not intended for buffer storage of compartments which are emptied or filled according to need, and the control for opening and closing the bottoms is not integrated in the installation. Hence the teaching contained in this patent does not make it possible to achieve the above-mentioned object.

To that end, in the installation according to the present invention, of the type initially described, the compartments are equipped with an opening bottom, and the conveying and storage system comprises several elongated and superposed "stories," each arranged for receiving a series of parallel compartments disposed in a row, and two vertical conveyor tracks connecting the stories to one another at their two ends, the system being disposed in a vertical plane and arranged for moving the compartments solely in translation along a circuit capable of comprising different routes, between the extractor and the feeder or vice versa, and the conduit being oriented in a direction which intersects the aforementioned vertical plane at a point adjacent to the conveying and storage system.

The inventive rod compartment for use with the above installation comprises a rigid structure formed of a front wall and two sidewalls, the mentioned opening bottom, and controllable connection means between the rigid structure and the opening bottom.

There is thus obtained a complete installation which works normally with a fixed number of compartments, some of which are empty and the rest full. The full compartments withdrawn at the outlet of the extractor may be routed toward the entrance to the feeder or be placed in reserve in the magazine; and the empty compartments may be recovered at the entrance to the feeder after being emptied and may be stored or routed toward the entrance to the extractor. The whole installation can operate automatically according to a required program as a function of data which are captured at different points of the installation and of commands supplied to the different drive means of the devices.

If need be, additional full compartments may be introduced into the system, or empty compartments may be withdrawn from it.

In an embodiment preferred for its simplicity, the compartments used have an opening bottom wall, e.g., a wall capable of sliding parallel to itself beyond the bottom of the compartment. In this case, the compartment-displacement means associated with the emptying station will be equipped with control means capable of opening the bottom of each full compartment introduced into the emptying device and of closing and, if need be, locking the bottom again when the compartment is reintroduced into the magazine after having been emptied.

A preferred embodiment of the invention will now be described in detail with reference to the accompanying drawings, in which.

Figure 1:
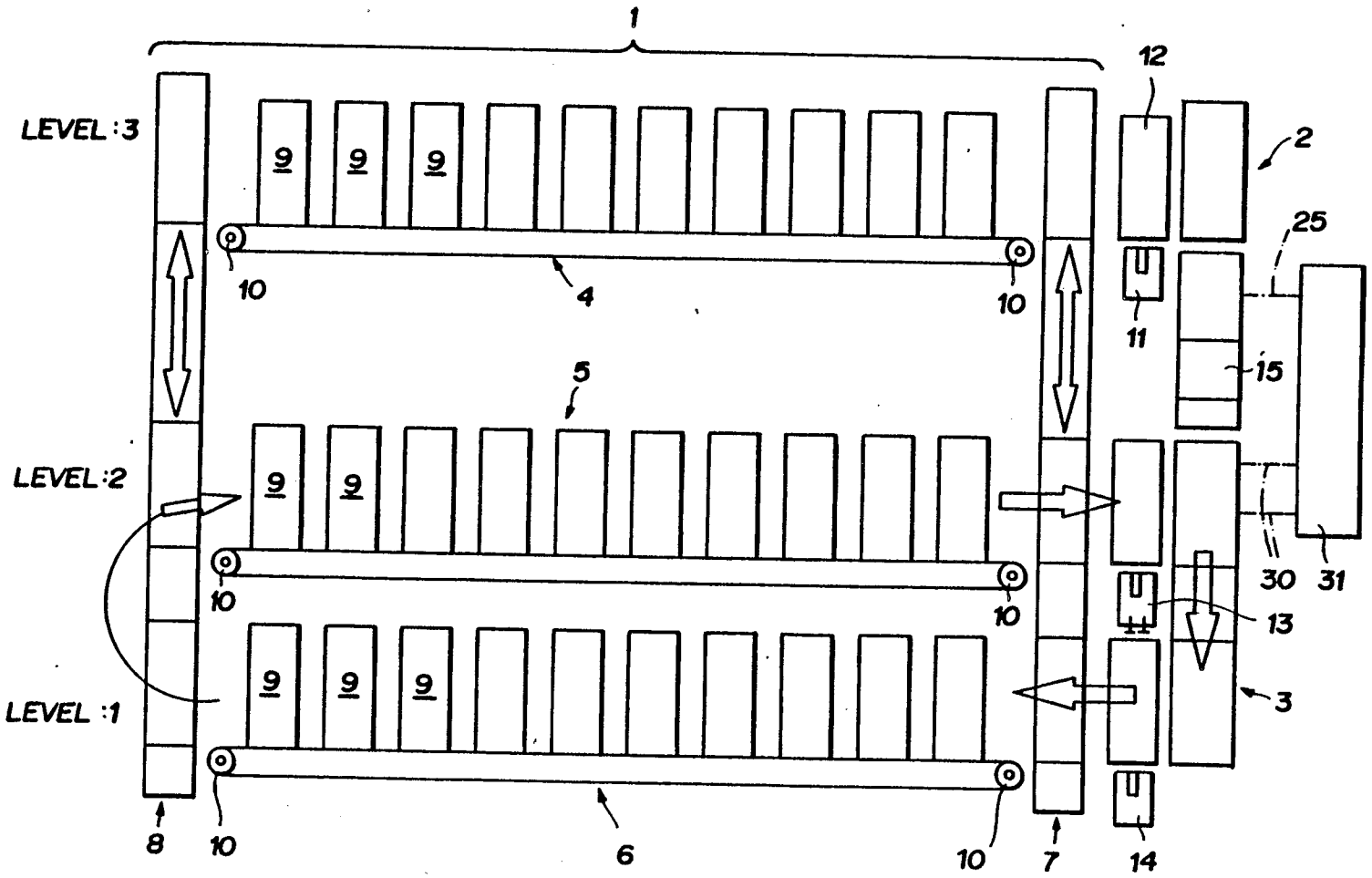
FIG. 1 is a diagrammatic elevation of the installation.
Figure 2:
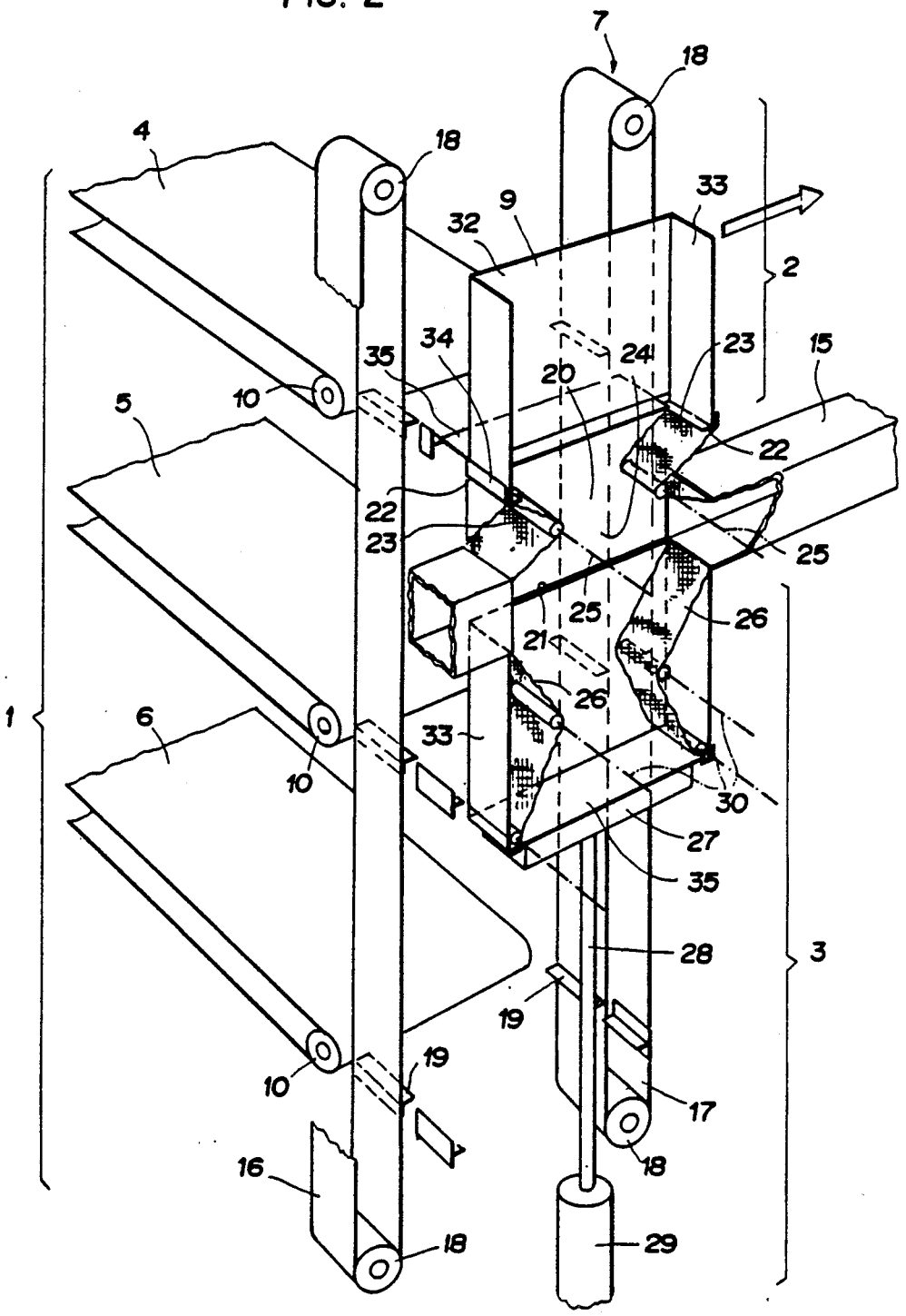
FIG. 2 is a partial perspective view.
Figures 3, 4, 5, 6:
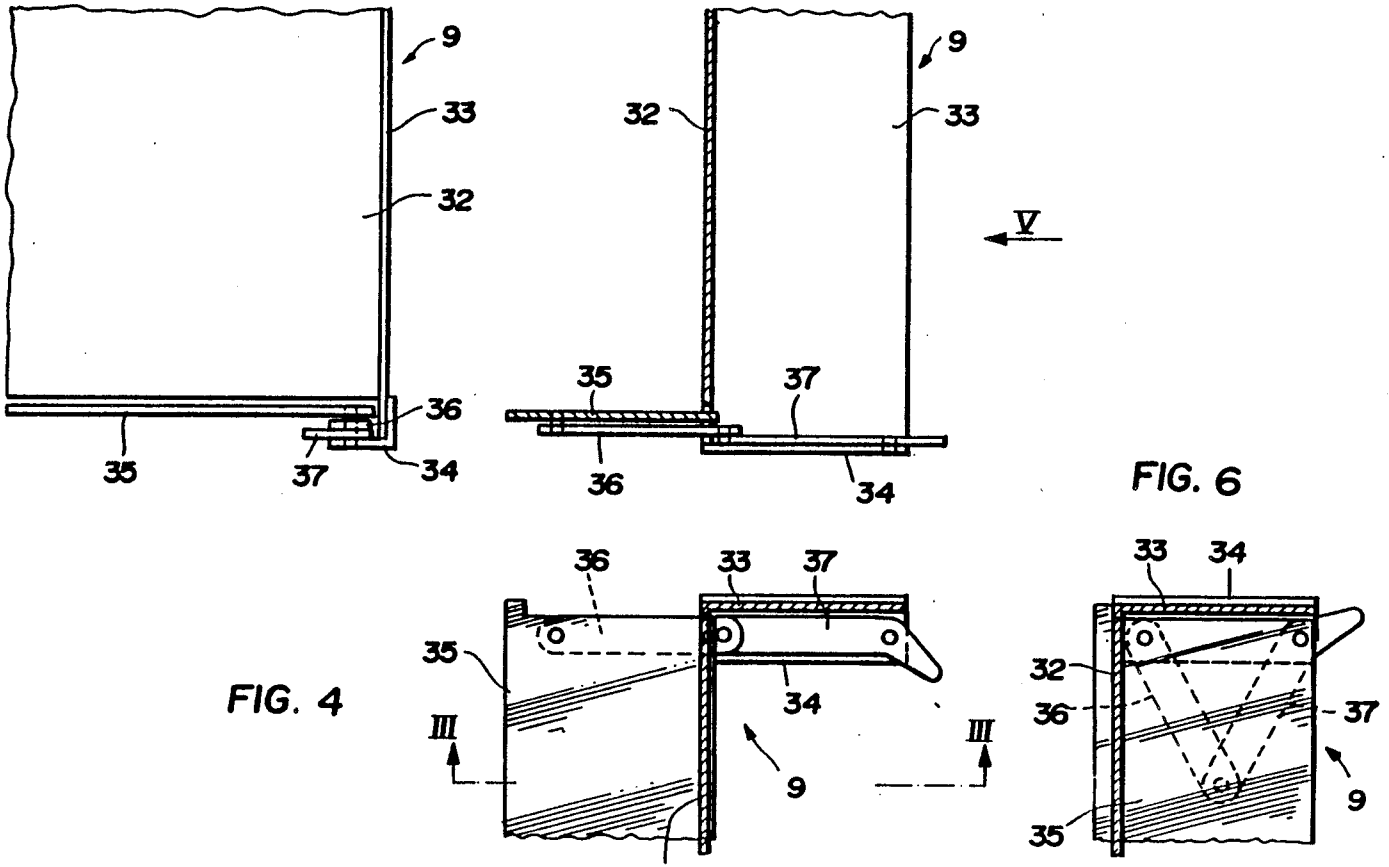
Figure 7:
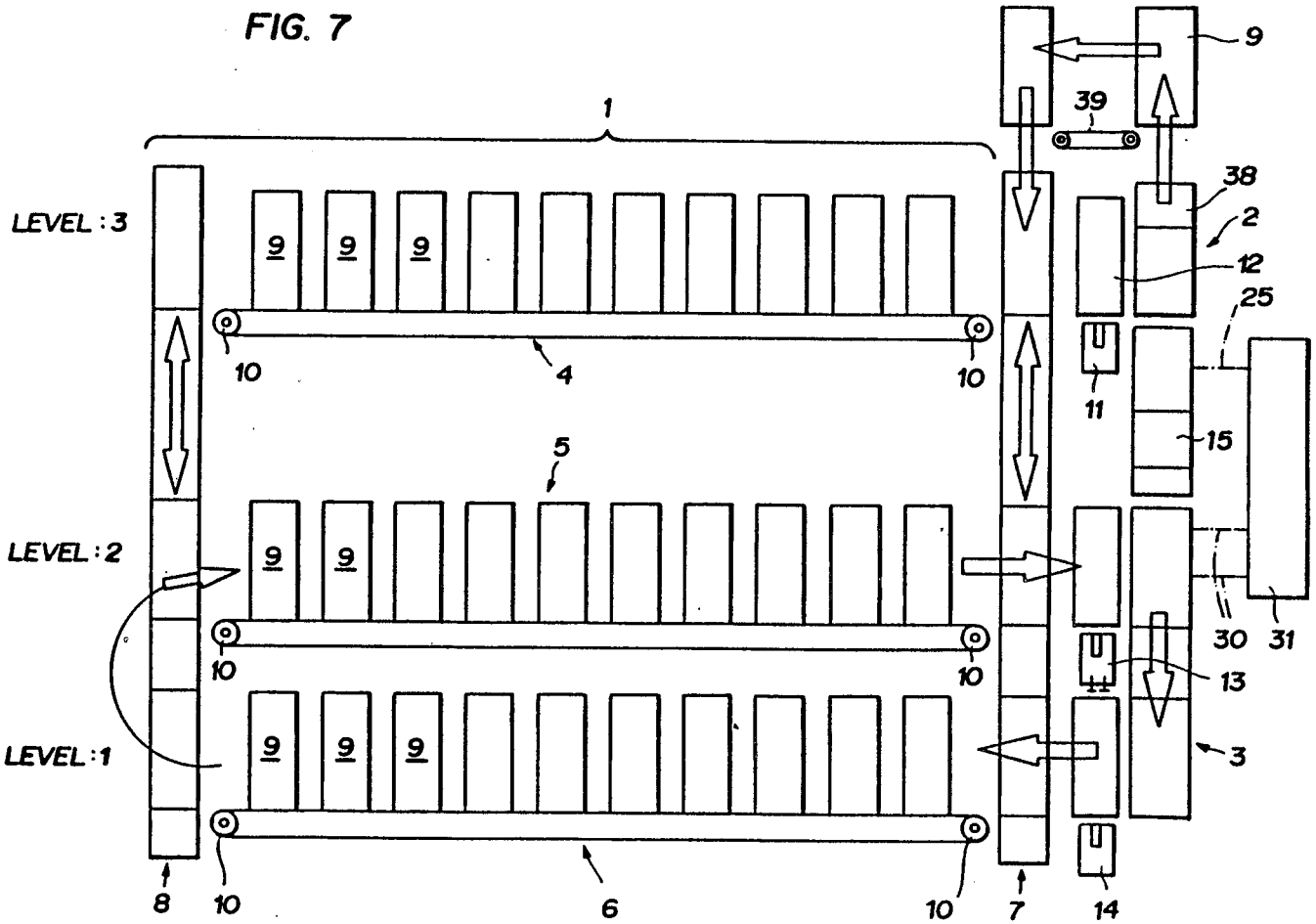
Figure 8:
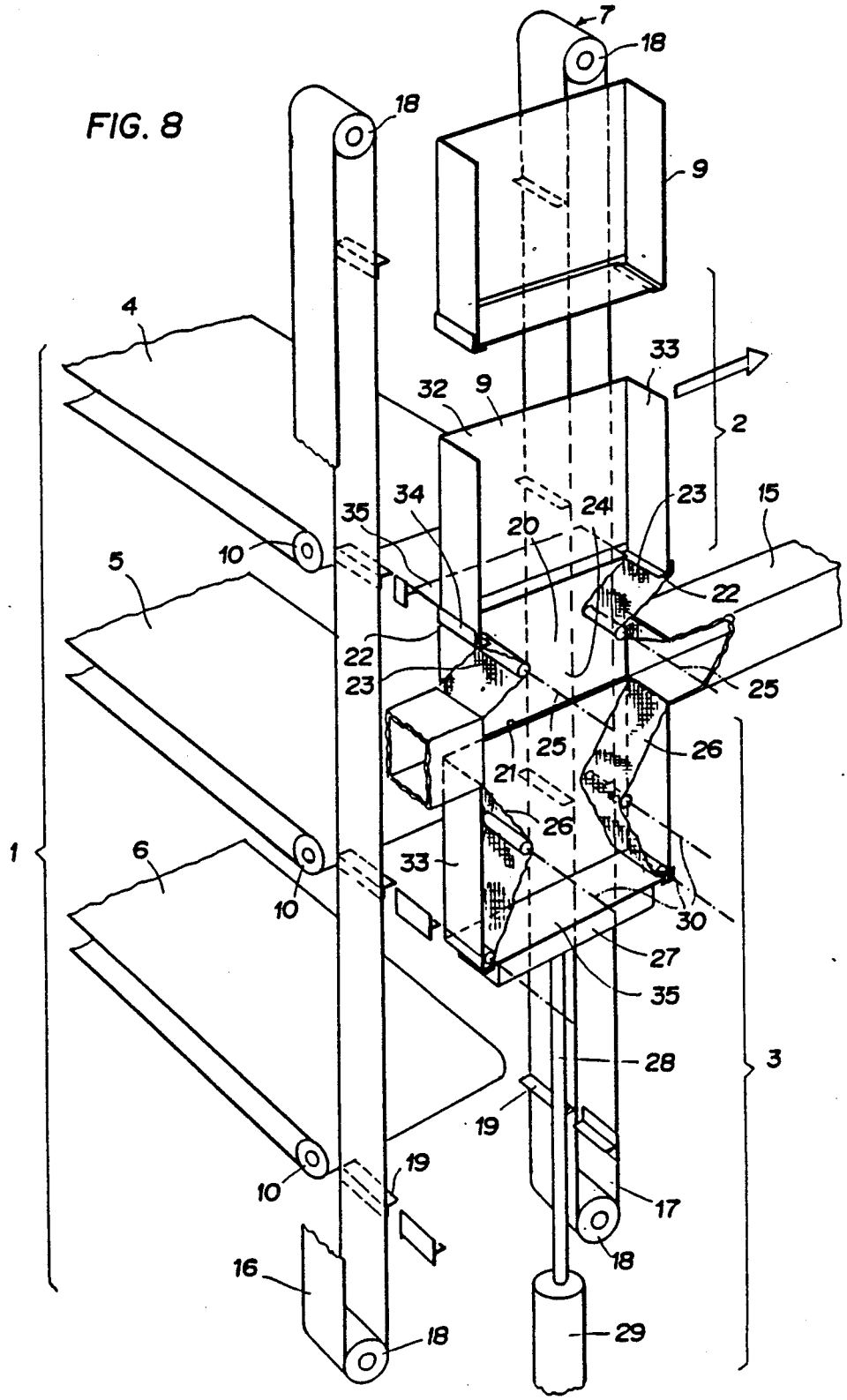

FIGS. 3, 4, 5, and 6 are partial views of a compartment, viz., a section taken on the line III—III of FIG. 4, a top plan view in open position, an elevation in the direction of arrow V of FIG. 3, and a top plan view in closed position, respectively, FIG. 7 is a view similar to FIG. 1 showing a modification of the transfer device, and FIG. 8 is a view similar to FIG. 2, also showing this modification.

The apparatus essentially comprises a magazine 1, an emptying station 2, also called a feeder, a filling station 3, also called an extractor, and means for capturing data and communicating commands (not shown). Magazine 1 comprises an upper conveyor 4, an intermediate conveyor 5, a lower conveyor 6, a front lift 7, and a rear lift 8. The horizontal conveyors are conveyor belts having a width adapted to that of the standard compartments 9, which will be placed upon them with their back wall disposed vertically on the side opposite stations 2 and 3. These belts are supported and driven by rollers 10 coupled, in a manner known per se, to motors (not shown). Preferably, the various conveyors 4, 5, and 6 are superposed and of the same length so as to be served by lifts 7 and 8 placed at the ends thereof.

Provided at the level of upper belt 4 and of emptying station 2 is a device 11 capable of carrying out various movements of compartments situated either at the end of conveyor 4 or on lift 7 or in station 2. Thus device 11 can take a full compartment situated at the front end of belt 4 and move it either onto lift 7 at the level of the upper belt or to the entrance 12 of station 2, where it is in waiting position. Device 11, which is an auxiliary of station 2, is likewise designed to move laterally, in the direction perpendicular to the plane of drawing of FIG. 1, or vertically, or some other way, a compartment which has emptied its load into a conduit 15. At the same time, it can close the bottom of this compartment again. In this way, a new full compartment can be moved by device 11 in synchronization from the waiting position in the emptying station. The empty compartment taken away by device 11 will, for example, be put aside laterally or vertically in a waiting position, then replaced on lift 7 and brought to the entrance of filling station 3 or onto conveyor 5.

A device 13, similar to device 11, is placed at the level of belt 5 to put empty compartments 9 one by one onto lift 7 or onto the front end of belt 5 and to introduce them, but without opening them at the bottom, into the entrance of filling station 3. A third lateral displacement device 14 is placed at the level of belt 6, under device 13, i.e., between lift 7 and filling station 3. It is intended to gather full compartments 9 at the exit post (see FIG. 2) of filling station 3 and to move them with translatory motion either onto lift 7 or onto the front end of belt 6.

Lift 7, as well as lift 8, may be designed as shown diagrammatically in FIG. 2. Two conveyor belts 16 and 17 are mounted vertically on rollers 18 having horizontal and parallel axes. At regular intervals, belts 16 and 17 bear supports 19 for engaging compartments 9. The control of driving rollers 18 subordinated to detectors of the presence of a compartment 9 on supports 19 and to the height of the position of these supports.

Emptying station 2 and filling station 3 will now be described in more detail. These stations act upon a flow of rods, e.g., filter rods or tips intended for cigarette manufacture, which pour into a conduit 15, the section of which shown in FIG. 1 is disposed horizontally. This is a type of conduit known to those skilled in the art, in which, conventionally, parallel rods oriented perpendicular to the direction of the conduit move in such a way as to represent a flow. The conduit is equipped with conveyor belts which are not shown but serve to move rods either from left to right or from right to left, as viewed in FIG. 2. The top and bottom surfaces of conduit 15 are interrupted at the locations of stations 2 and 3 and thus present openings 20, 21 for the insertion and extraction of the rods.

Emptying station or feeder 2 comprises a fixed support 22 intended to receive a succession of full compartments 9. Preferably, the mechanism for opening the bottom of the compartment placed on support 22 will be actuated once the presence of the compartment at this location has been detected. The two rigid elements of support 22 are each connected by a length of flexible tape 23 to one of the edges of opening 20, so that the two lengths 23 , together with the fixed front and back walls 24 of station 2, bound a hopper guiding the feeding of the rods in conduit 15. Vibrators 25 ensure the introduction by acting upon tapes 23.

Filling station or extractor 3 likewise comprises two lengths of flexible tape 26 attached to the two edges of opening 21. Lengths 26 are arranged to ensure the gradual filling of an empty compartment 9 closed at the bottom and placed on a movable support 27, e.g., a horizontal tray fixed to the end of a piston-rod 28 integral with the piston of a jack 29. Vibrators 30 control the vibrations and movements of tapes 26. An empty compartment 9 coming from conveyor 5 may be fitted over walls 26 so as to rest upon tray 27 in upper position, after which, as tray 27 is lowered, the rods extracted from conduit 15 through opening 21 accumulate in the compartment. When the compartment is at the level of conveyor 6, it is completely filled, and lateral displacement device 14 can route it either toward lift 7 or toward conveyor 6. A device 31 for driving components 25 and 30 is also shown in FIG. 1.

FIGS. 3–6 show a possible form of producing compartments 9. Each of them comprises a rectangular back wall 32 and two vertical sidewalls fixed rigidly to wall 32, parallel and provided at the bottom with an inner rim 34. The compartment further comprises a bottom wall 35, each end of which is attached to one of the rims 34 by a linkage system composed of two small bars 36, 37 hinged to one another, one of which is further hinged to bottom plate 35 and the other to one of the rims 34. The linkage system may be controlled by various means to cause the opening bottom 35 to move from the position of FIGS. 3, 4, and 5 to that of FIG. 6, e.g., by jacks which may be associated with supports 22 (see FIG. 2). The means for controlling the linkage system may also be of the electromagnetic type. Instead of an articulated system for moving bottom 35, it would be possible to provide a simple parallel guidance and a jack control, the latter being mounted, as the case may be, on the compartment itself.

The installation described presents the great advantage of making it possible to direct at will the feeding of one or more machines, such as packaging machines or assemblers. Furthermore, it comprises a significant buffer with a reduced volume. The magazine may comprise any proportion of full and empty compartments. Any empty compartment situated on one of the conveyors may be brought to the entrance of the extractor, then once filled, be reinserted in the magazine without disturbing the operations in progress. By the same token, any full compartment may be brought to the entrance of the feeder, and once emptied be reinserted in the magazine. Feeding may be continuous or intermittent. Empty or full compartments may also be introduced manually or automatically from pallets. For that purpose, lifts 7 and 8 may be arranged so that at least one of them comprises a loading station situated at a level higher than that of conveyor 4 or at a level lower than that of conveyor 6. Direction of the flow of rods can therefore be very flexible. The operations to be effected for distributing the full compartments and the empty compartments on conveyors 4, 5, and 6 according to a sensible arrangement in the different situations which may arise can be programmed and directed by computer. The handling of the compartments does not require any turnover operation or pivoting of a pair of compartments, and the movements are solely translatory.

FIGS. 7 and 8 show a modification of the design of the transfer apparatus 11. A grasping means 38 co-operates with the feeder 2 so as to be able to seize a compartment 9 which has just been emptied and lift it vertically into a position such that the entrance 12 of the station 2 is cleared, so that a new, full compartment 9 can immediately be brought into emptying position. A second auxiliary means 39 then receives the compartment 9 lifted and transfers it to the upper position of lift 7. This empty compartment can thereafter be moved downward once more to the level of conveyor 5 and be put in storage on the conveyor belt at that level.

What is claimed is:

1. A rod-conveying installation of the type having a conduit for receiving a flow of parallel rods oriented perpendicular to the direction of said conduit, an extractor for extracting rods from said conduit at a first location, a feeder for introducing rods into said conduit at a second location, a plurality of compartments for holding said rods, a compartment-filling means associated with said extractor, a compartment-emptying means associated with said feeder and a system for conveying and storing said compartments, wherein said compartments include an opening bottom, said conveying and storage system comprising two or more elongated and superposed levels for respectively receiving a number of parallel said compartments disposed in a row, and two vertical conveyor tracks interconnecting said levels at the ends thereof, said system being disposed in a vertical plane and arranged for moving said compartments solely in translation along a circuit capable of comprising different routes between said extractor and said feeder or vice versa, and said conduit being oriented in a direction intersecting said vertical plane at a point adjacent to said conveying and storage system.

2. The installation of claim 1, wherein said conduit includes a horizontal top wall and a horizontal bottom wall, said first and second locations being directly superposed openings in said top wall and said bottom wall, respectively.

3. The installation of claim 2, further comprising at least one transfer apparatus associated with said feeder or with said extractor for withdrawing a said compartment from said circuit to make way for a new said compartment.

4. The installation of claim 3, wherein said extractor includes an entrance post and an exit post, said conveying and storage system comprising a first said level at the elevation of said feeder, a second said level at the elevation of said entrance post, and a third said level at the elevation of said exit post, said transfer apparatus being placed at each said level between the said conveyor track nearest said conduit and the assembly consisting of said conduit, said feeder, and said extractor.

5. The installation of claim 4, wherein said levels each comprise a conveyor belt capable of receiving rod compartments placed on edge one behind the other in a series.

6. The installation of claim 5, wherein said conveyor belts are horizontal.

7. The installation of claim 4, wherein said vertical conveyor tracks are lifts capable of receiving simultaneously a said compartment at each of said levels and of moving said compartments to another said level.

* * * * *